US005404656A

United States Patent [19]

Matsuda et al.

[11] Patent Number: 5,404,656

[45] Date of Patent: Apr. 11, 1995

[54] METHOD OF CONTROLLING DRYING AIR TEMPERATURE OF PHOTOSENSITIVE MATERIAL DRYING APPARATUS

[75] Inventors: Shinichi Matsuda; Junichi Kose, both of Kanagawa, Japan

[73] Assignee: Fuji Photo Film Co., Ltd., Kanagawa, Japan

[21] Appl. No.: 158,571

[22] Filed: Nov. 29, 1993

[30] Foreign Application Priority Data

Nov. 27, 1992 [JP] Japan ..... 4-319037

[51] Int. Cl.[6] ..... F26B 3/00

[52] U.S. Cl. ..... 34/446; 34/493; 34/549; 34/535; 354/299

[58] Field of Search ..... 34/444, 446, 524, 549, 34/553, 535, 557, 573, 443, 445, 493, 497, 498; 354/299, 319, 320, 321, 322

[56] References Cited

U.S. PATENT DOCUMENTS 4,914,835 4/1990 Kose et al. ..... 34/446
4,916,829 4/1990 Takiue et al. ..... 34/446
4,952,960 8/1990 Kosugi ..... 354/299

*Primary Examiner*—John M. Sollecito
*Attorney, Agent, or Firm*—Sughrue, Mion, Zinn Macpeak & Seas

[57] ABSTRACT

A method of controlling the temperature of drying air in a photosensitive material drying apparatus for drying the photosensitive material processed by processing solutions. The method comprises the steps of: calculating an environmental absolute humidity $Z_E$ of a vicinity of the photosensitive material drying apparatus; calculating a processing amount S of the photosensitive material per unit time; calculating a drying air temperature $T_D$ on the basis of the environmental absolute humidity $Z_E$ and the processing amount S of the photosensitive material so that a difference between the drying air temperature $T_D$ and a wet-bulb temperature TW in the photosensitive material drying apparatus falls within a predetermined range of a value; and controlling a heater for heating the drying air on the basis of the drying air temperature $T_D$.

20 Claims, 10 Drawing Sheets

METHOD OF CONTROLLING DRYING AIR TEMPERATURE OF PHOTOSENSITIVE MATERIAL DRYING APPARATUS

BACKGROUND OF THE INVENTION

1. Field of the Invention

The present invention relates to a method of controlling the drying air temperature of a photosensitive material drying apparatus for drying a photosensitive material processed by processing solutions.

2. Description of the Related Art

In recent years, there has been a growing demand for high-quality and speedy processing of such photosensitive materials as graphic arts photosensitive materials, photosensitive materials for scanners, and photosensitive materials for X-ray films. These photosensitive materials are automatically processed by an automatic developing apparatus by using processing solutions such as a developing solution, a fixing solution, washing water, and the like, and are then dried.

In a drying section of this automatic developing apparatus, outside air which is introduced from outside the processor is heated by a heater. This heated warm air is blown onto the photosensitive material.

Since the photosensitive material is dried while being transported through the drying section at a predetermined speed, the drying of the photosensitive material must be completed within a predetermined time during which the photosensitive material passes through the drying section (i.e., transport distance/transport speed), and the temperature of the heater is set accordingly.

However, in a case where the amount of the photosensitive material dry processed per unit time increases, the humidity in the drying section becomes high over time and the drying conditions change, causing a decline in drying capability. Hence, it is effective, for example, to increase the drying capability by setting the heater temperature to a high level so as to increase the temperature within the drying section. However, if dry processing is continued while maintaining the heater temperature at the high level merely to secure the drying capability irrespective of this change in the drying conditions, when the amount of dry processing is small, the photosensitive material may possibly become overdried, and become curled or reduced in size to such an extent that the dimensions of the photosensitive material are not restorable.

To overcome this problem, if the heater temperature is set to a low value (i.e., a value close to a lower limit in securing the drying capability), the overdrying of the photosensitive material can be prevented.

Nevertheless, if the heater temperature is set to a low value, when the amount of dry processing is large, drying is conversely completed in a state in which the photosensitive material is underdried, so that strips of photosensitive material which are discharged consecutively from the automatic developing apparatus can possibly adhere to each other. Also, it is conceivable to change the set temperature of drying air in correspondence with the amount of processing in the drying section. However, there are cases where the temperature of the warm air fluctuates by large degrees to high and low levels owing to the relationship with the on-off control of the heater for maintaining the drying air temperature to a set level, thereby causing unevenness in drying.

Furthermore, since the state of drying the photosensitive material is affected by the water content prior to drying and the environmental conditions in which the processor is installed (particularly the absolute humidity), it is very difficult to maintain the state of drying the photosensitive material in a fixed state.

SUMMARY OF THE INVENTION

Accordingly, it is an object of the present invention to provide a method of controlling the drying air temperature for a photosensitive material drying apparatus which makes it possible to prevent the occurrence of underdrying and unevenness in the drying of a photosensitive material and finish the dried state of the photosensitive material to an optimal state.

In accordance with a first aspect of the present invention, there is provided a method of controlling the temperature of drying air in a photosensitive material drying apparatus for drying the photosensitive material processed by processing solutions, comprising the steps of: calculating an environmental absolute humidity $Z_E$ of a vicinity of the photosensitive material drying apparatus; calculating a processing amount S of the photosensitive material per unit time; calculating a drying air temperature $T_D$ on the basis of the environmental absolute humidity $Z_E$ and the processing amount S of the photosensitive material so that a difference between the drying air temperature $T_D$ and a wet-bulb temperature $T_W$ in the photosensitive material drying apparatus falls within a predetermined range of a value; and controlling a heater for heating the drying air on the basis of the drying air temperature $T_D$.

In accordance with a second aspect of the present invention, there is provided a method of controlling the temperature of drying air for use in a photosensitive material drying apparatus for drying the photosensitive material processed by processing solutions, and for drying the photosensitive material being transported in the photosensitive material drying apparatus by using the drying air heated by a heater, comprising the steps of: calculating an environmental absolute humidity $Z_E$ of a vicinity of the photosensitive material drying apparatus; calculating a processing amount S of the photosensitive material per unit time; calculating a drying air temperature $T_D$ on the basis of the environmental absolute humidity $Z_E$, the processing amount S of the photosensitive material, a water content W of the photosensitive material prior to drying, and an exhausted air amount Q of the drying air so that a difference between the drying air temperature $T_D$ and a wet-bulb temperature $T_W$ in the photosensitive material drying apparatus falls within a predetermined range of a value; and controlling the heater on the basis of the drying air temperature $T_D$.

In accordance with a third aspect of the present invention, if it is assumed in the second aspect of the invention that coefficients are $\alpha$, $\beta$ and $\gamma$ and a correction coefficient is K, the drying air temperature $T_D$ is expressed by the following formulae:

$$T_D = \frac{-\beta + \sqrt{\beta^2 - 4\alpha(\gamma - Z)}}{2\alpha} + K \quad (1)$$

$$Z = Z_E + \frac{W \cdot S}{Q} \quad (2)$$

The photosensitive material processed by processing solutions, including a developing solution, a fixing solution, and washing water, is squeegeed by squeegee rollers or the like, and is then transported to the drying section. Drying air heated by a heater is sent to the drying section by means of a fan, and is blown onto the photosensitive material being transported through the drying section, thereby allowing the photosensitive material to be dried.

Here, in accordance with the first aspect of the present invention, the drying air temperature is determined on the basis of the environmental absolute humidity in the vicinity of the photosensitive material drying apparatus and the processing amount of the photosensitive material per unit time such that a difference between the drying air temperature and the wet-bulb temperature in the photosensitive material drying apparatus is maintained in a predetermined range of a value. The drying air temperature is adjusted by controlling the heater so that this drying air temperature will be reached. As a result, an optimum drying air temperature can be maintained, and the photosensitive material can be dried in a satisfactory state.

In accordance with the second aspect of the present invention, the drying air temperature is determined on the basis of the environmental absolute humidity in the vicinity of the photosensitive material drying apparatus, the processing amount of the photosensitive material per unit time, the water content of the photosensitive material prior to drying, and the exhausted air amount of the drying air such that a difference between the drying air temperature and the wet-bulb temperature in the photosensitive material drying apparatus is maintained within a predetermined range of a value. The drying air temperature is adjusted by controlling the heater so that this drying air temperature will be reached. As a result, the drying air temperature can be maintained at a level optimally suited to the drying conditions prevailing at that time, and the photosensitive material can be dried in a satisfactory state from an initial period to a final period of drying.

In accordance with the third aspect of the present invention, the drying air temperature $T_D$ is expressed by Formulae (1) and (2) above, but the coefficients $\alpha$, $\beta$, and $\gamma$ vary depending on the structure and conditions of the photosensitive material drying apparatus.

More specifically, the coefficients $\alpha$, $\beta$, and $\gamma$ are calculated in advance or determined experimentally on the basis of the number of rollers used in the drying apparatus as their diameter, the number of slit nozzles through which drying air is blown, the opening width of the slit nozzle, the opening length of the slit nozzle, the virtual drying path length, the distance from the tip of the slit nozzle at its opening to the photosensitive material being transported in the drying apparatus, the drying air amount, the exhausted air amount, and the traveling speed of the photosensitive material in the drying apparatus. Here, the drying air amount refers to an amount of the total drying air discharged from the slit nozzles per unit time, while the exhausted air amount refers to an amount of air discharged per unit time to outside the machine with respect to the drying air.

In addition, the correction coefficient K is a coefficient for correcting uncontrollable drying factors, such as the sizes of photosensitive materials already processed, the number of strips of photosensitive material processed, and the elapsed time from the previous processing of the photosensitive material until the present processing. The correction coefficient K is determined in advance through experiments or the like.

Thus, a drying air temperature which is optimally suited to an applied drying apparatus can be obtained by determining the coefficients $\alpha$, $\beta$, and $\gamma$ on the basis of the structure and the like of the drying apparatus, by determining the correction coefficient K, and by substituting into formulae the environmental absolute humidity $Z_E$ Of the vicinity of the photosensitive material drying apparatus, the processing amount S of the photosensitive material per unit time, the water content W of the photosensitive material prior to drying, and the exhausted air amount Q of the drying air.

It should be noted that the environmental absolute humidity $Z_E$ can be determined from an environmental temperature T and an environmental relative humidity H. That is, the environmental absolute humidity $Z_E$ is determined by substituting the environmental temperature T and the relative humidity H into the following Formula (3):

$$Z_E = 3.8 \exp(-1.696 \times 10^{-6} \cdot T^3 - 9.034 \times 10^{-5} \cdot T^2 + 0.069748 \cdot T) \frac{H}{100} \quad (3)$$

Also, the coefficients $\alpha$, $\beta$, and $\gamma$, which vary depending on the structure and conditions of the photosensitive material drying apparatus, generally fall within ranges that are determined in Formula (4) below.

It should be noted that a temperature range of $\pm 3°$ C. is allowed for the drying air temperature $T_D$ in respective cases in which it is determined in accordance with the first to third aspects of the present invention.

$$\left.\begin{array}{l} 0.01 \leqq \alpha \leqq 0.06 \\ -1.00 \geqq \beta \geqq -8.00 \\ 5 \leqq \gamma \leqq 250 \end{array}\right\} \quad (4)$$

Preferably, the coefficients $\alpha$, $\beta$, and $\gamma$ fall into the ranges of the following Formula (5):

$$\left.\begin{array}{l} 0.037 \leqq \alpha \leqq 0.047 \\ -2.48 \geqq \beta \geqq -4.93 \\ 40 \leqq \gamma \leqq 128 \end{array}\right\} \quad (5)$$

As described above, the method of controlling the drying air temperature for a photosensitive material drying apparatus in accordance with the present invention offers outstanding advantages in that the photosensitive material can be dried to an optimal state by preventing the finished quality of the photosensitive material from becoming deteriorated due to underdrying or overdrying without being affected by the environmental conditions of a place of installation of the photosensitive material drying apparatus, and that the amount of heat from the heating means used in drying can be minimized.

The above and other objects, features and advantages of the invention will become more apparent from the following detailed description of the invention when read in conjunction with the accompanying drawings.

DESCRIPTION OF THE PREFERRED EMBODIMENTS

Referring now to the accompanying drawings, a description will be given of an automatic developing apparatus 10 to which the drying method in accordance with the present invention is applied.

Figure 1:
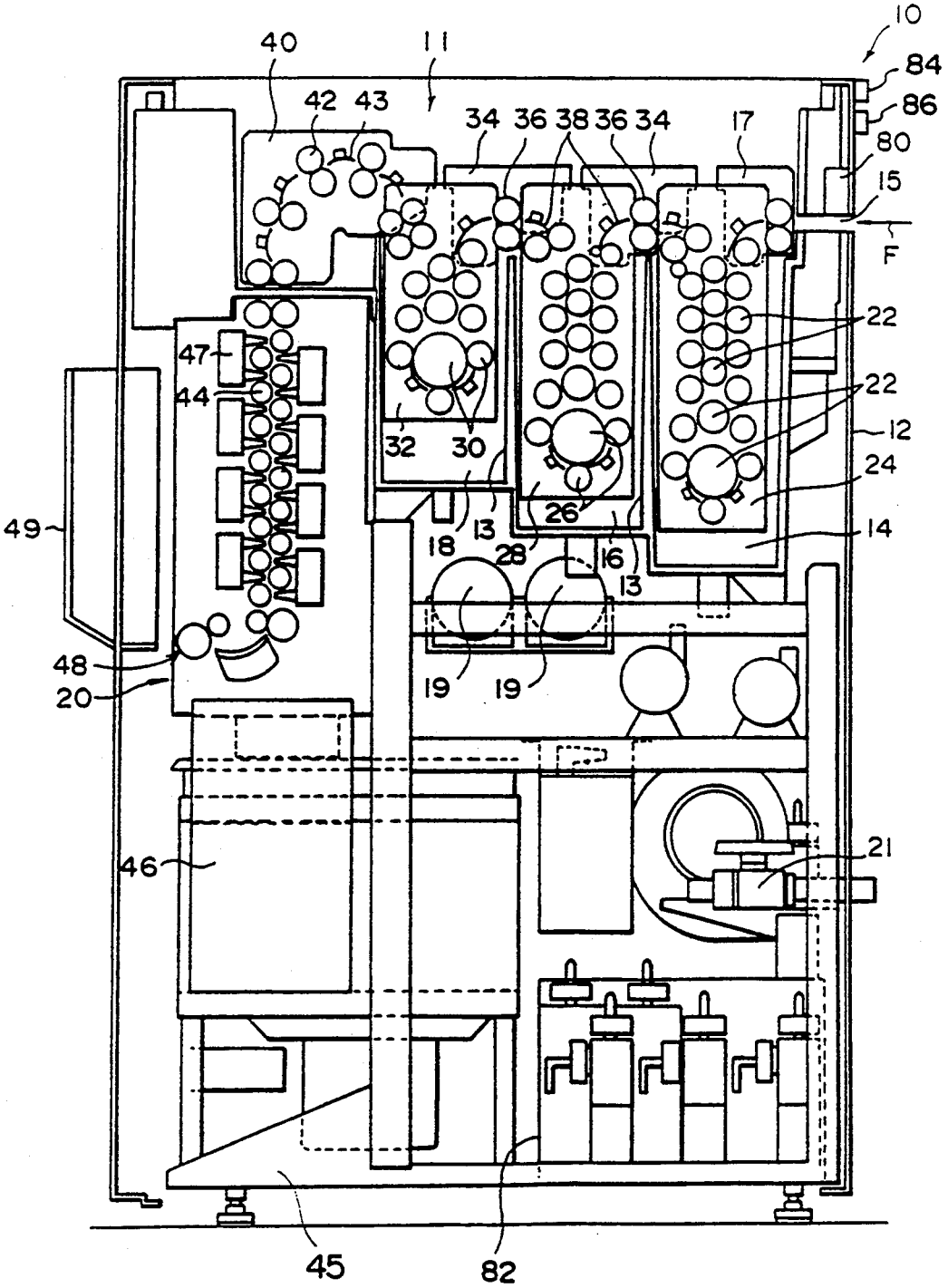
FIG. 1 is a schematic diagram of an example of an automatic developing apparatus to which the drying method in accordance with the present invention is applied.

As shown in FIG. 1, a processing section 11 and a drying section 20 are provided within a machine frame 12 of the automatic developing apparatus 10. The processing section 11 has a developing tank 14, a fixing tank 16, and a washing tank 18 that are arranged along the direction of travel of film F and are partitioned by partition walls 13.

An insertion rack 17 for drawing the film F into the automatic developing apparatus 10 is disposed in the vicinity of an insertion port 15 for the film F in the automatic developing apparatus 10.

In addition, insertion detecting sensors 80 are disposed in the vicinity of the insertion port 15 for detecting the film F being inserted. These insertion detecting sensors 80 are arranged at predetermined intervals in the widthwise direction of the film F so as to separately detect the presence or absence of the film F, respectively. Accordingly, films F with varying widths can be discriminated on the basis of the states of detection by these insertion detecting sensors 80, with the result that the width of the film F can be determined. The length of the film F can also be detected from the transport speed of the film F and the time duration from the start of the detection of the film F by the insertion detection sensors 80 until the completion thereof. As a result, since the film area can be calculated by the product of the width and the length of the film F, it is possible to calculate a film processing area S per unit time. Signal lines of these insertion detecting sensors 80 are electrically connected to a controller 82.

An insertion table for manually inserting the film F or an automatic feeder for automatically inserting the film F by a transporting means can be installed at the insertion port 15 of the automatic developing apparatus 10.

A temperature sensor 84 and a relative humidity sensor 86 are attached to an outer peripheral portion of the machine frame 12 so as to detect an environmental temperature T and an environmental relative humidity H at the place of installation of this apparatus (i.e., the automatic developing apparatus 10). The temperature sensor 84 and the relative humidity sensor 86 have respective signal lines electrically connected to the controller 82.

The controller 82 calculates an environmental absolute humidity $Z_E$ by using Formula (3) above on the basis of the temperature and the relative humidity obtained by the temperature sensor 84 and the relative humidity sensor 86.

A developing solution is accommodated in the developing tank 14, and a transporting rack 24 having transport rollers 22 for transporting the film F by being driven by an unillustrated motor is immersed in the developing solution. A fixing solution is accommodated in the fixing tank 16, and a transporting rack 28 having transport rollers 26 for transporting the film F by being driven by the unillustrated motor is immersed in the fixing solution. In addition, washing water is accommodated in the washing tank 18, and a transporting rack 32 having transport rollers 30 for transporting the film F by being driven by the unillustrated motor is immersed in the washing water.

Heat exchangers 19 are disposed below the developing tank 14 and the fixing tank 16, respectively. The developing solution in the developing tank 14 and the fixing solution in the fixing tank 16 are respectively sent to the heat exchangers 19, and after being subjected to heat exchange there, the solutions are sent back to the developing tank 14 and the fixing tank 16. As a result, the temperatures of the developing solution in the developing tank 14 and the fixing solution in the fixing tank 16 are maintained within predetermined ranges.

Crossover racks 34 are disposed over the partition wall between the developing tank 14 and the fixing tank 16 and over the partition wall between the fixing tank 16 and the washing tank 18. These crossover racks 34 are each provided with a pair of transport rollers 36 for transporting the film F from the upstream tank to the downstream tank in the direction of travel of the film F as well as a guide 38 for guiding the film F.

Accordingly, the film F which has been inserted into the automatic developing apparatus 10 through the insertion port 15 is inserted into the developing tank 14 by means of the insertion rack 17 and is transported through the developing solution by means of the transport rollers 22 so as to be subjected to development. The film F thus developed is transported to the fixing tank 16 by means of the crossover rack 34 and is transported through the fixing solution by means of the transport rollers 26 so as to be subjected to fixing. The film F thus fixed is transported to the washing tank 18 by means of the crossover rack 34 and is transported through the washing water by means of the transport rollers 30 so as to be subjected to washing. The film F is thus processed.

An unillustrated solution discharge pipe is fixed to the bottom of each of the developing tank 14, the fixing tank 16, and the washing tank 18, and each of these solution discharge pipes is provided with a solution discharge valve 21. Accordingly, by opening these solution discharge valves 21, it is possible to discharge the developing solution, the fixing solution, and the washing water which are respectively accommodated in the developing tank 14, the fixing tank 16, and the washing tank 18.

A squeeze rack 40 is disposed between the washing tank 18 and the drying section 20. This squeeze rack 40 has guides 43 for guiding the film F and pairs of transport rollers 42 for transporting the film F to the drying section 20 as the film F, which has been transported from the washing tank 18 and onto which the washing water has been adhered, is being transported and the washing water is squeezed off the film F by the squeeze rack 40.

The drying section 20 comprises transport rollers 44 for transporting the film F, a drying fan 45 for supplying drying air, a chamber 46 incorporating a heater for heating the drying air, and spray pipes 47 for spraying the heated drying air onto both the film F and the transport rollers 44. In addition, a dry turning section 48 is disposed downstream from the transport rollers 44 in the transport passage of the film F, so as to transport the film F diagonally upward.

A film receiving box 49 for accommodating the film F transported from the dry turning section 48 is disposed on the automatic developing apparatus 10 in such a manner as to project from an outer wall of the automatic developing apparatus 10.

Accordingly, the film F with the washing water squeezed off at the squeeze rack 40 is dried by drying air blown from the spray pipes 47 while the film F is being transported by the transport rollers 44 heated by the drying air whose temperature is increased in this drying section 20. Subsequently, the direction of travel of the film F is turned by the dry turning section 48 and the film F is then transported to the film receiving box 49 so as to be accommodated therein.

Figure 2:
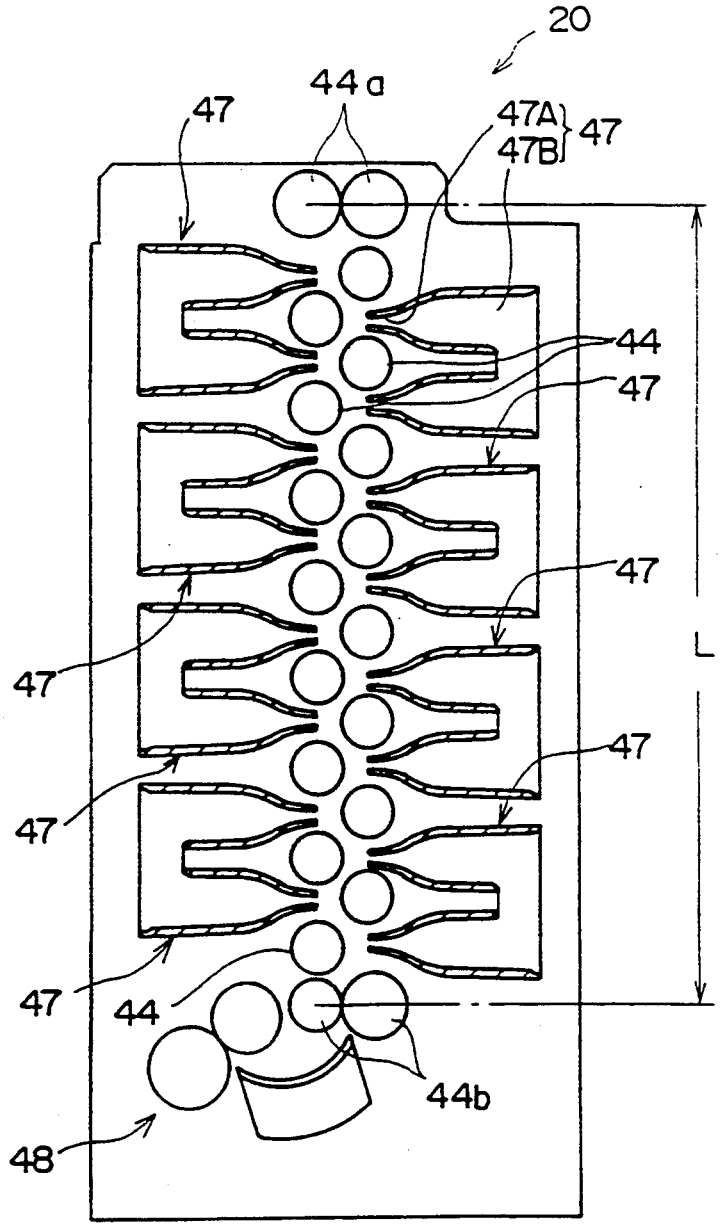
FIG. 2 is a schematic diagram illustrating the structure of a drying section of the automatic developing apparatus shown in FIG. 1.

FIG. 2 shows a detailed structure of the drying section 20. In the drying section 20, a pair of opposing nip rollers **44*a* are disposed on the inner side of the inlet port, followed by the aforementioned transport rollers 44. The transport rollers 44 are arranged in a zigzag manner along the transport passage of the film F. For this reason, the film F can be transported substantially rectilinearly (i.e., vertically downward in FIG. 2) in a stable manner without being nipped by strong forces. The transport rollers 44 are comprised of, for example, eight rollers on each of the obverse and reverse sides of the film F, i.e., a total of 16 rollers. The outside diameter of each of these rollers is 20 mm. Disposed downstream from the row of transport rollers 44 is the dry turning section 48 which is comprised of a pair of nip rollers 44*b***, a guide plate, and a pair of discharge rollers.

The film F is transported by these transport rollers 44 at a speed of 46.8 mm/sec., and its virtual drying path length is set at 305 mm.

Here, the virtual drying path length refers to the length from the axial center of an initial nip roller **44*a* to a final nip roller 44*b* in the drying region for drying the film F. In FIG. 2, for instance, this length corresponds to to a distance L from the axes of the pair of nip rollers 44*a* to the axes of the pair of nip rollers 44*b***.

Meanwhile, each of the spray pipes 47 is comprised of a nozzle portion 47A projecting between adjacent ones of the transport rollers 44 toward the transport passage of the film F as well as a subchamber portion 47B for making uniform the amount of drying air blown through this nozzle portion 47A in the longitudinal direction of the transport roller 44, i.e., in the widthwise direction of the film F. Four subchambers 47B are provided on each of the obverse and reverse sides of film F, i.e., a total of eight subchambers. The structure adopted is such that two nozzle portions 47A project from one subchamber portion 47B. Accordingly, a total of 16 drying air blow ports are provided facing the transport passage of the film F.

The blow port of this nozzle portion 47A (an opening facing the film F) has a slit width of 2.5 mm and a nozzle length of 470 mm.

In this drying section 20, the amount of drying air blown from the blow ports of the nozzle portions 47A during film processing is approximately 11 $m^3$/min, and the amount of exhausted air Q is approximately 2 $m^3$/min. At this time, a fresh air amount of approximately 2 $m^3$/min corresponding to the exhausted air amount Q is newly introduced into the drying section 20.

As a first method for controlling the temperature of the drying air, there is a method in which an optimum drying air temperature $T_D$ is determined from Formulae (1) and (2) above, and the heating of the drying air is controlled on the basis of it.

The coefficients $\alpha$, $\beta$, and $\gamma$ in Formula (1) are predetermined depending on the configuration of the drying section, and in the case of the drying section 20 in this embodiment configured as described above these coefficients $\alpha$, $\beta$, and $\gamma$ are expressed as shown in the following Formulae (6):

$$\left.\begin{array}{lll} 0.04345 \leqq \alpha \leqq 0.04654; & \alpha = 0.04521 & \text{(optimum value)} \\ -3{,}9762 \geqq \beta \geqq -4.6750; & \beta = -4.3348 & \text{(optimum value)} \\ 88.67 \leqq \gamma \leqq 115.11; & \gamma = 101.54 & \text{(optimum value)} \end{array}\right\} \quad (6)$$

In addition, the absolute humidity Z in the drying section 20, which is a parameter in Formula (1), can be obtained from the aforementioned environmental absolute humidity $Z_E$, the exhausted air amount Q (in this embodiment, 0.0367 kg/sec), the processing area S per unit time, and the water content W (in this embodiment, 15.8 g/$m^2$) of the film F prior to drying by using Formula (2).

Namely, the heater is controlled to obtain the drying air temperature $T_D$ calculated by Formula (1) above, and the drying air thus heated is sent to the spray pipes 47 so as to be blown onto the film F through the nozzle portions 47A. In this case, since the difference $\Delta T$ between the drying air temperature $T_D$ detected by an unillustrated detecting means in the drying section 20 and a wet-bulb temperature $T_W$ (at the drying air temperature $T_D$) falls within a predetermined range (in this embodiment, 34° C.$\leqq\Delta T\leqq$37° C.; optimal when $\Delta T$=35° C.), optimal drying is maintained in the drying section 20.

Figure 3:
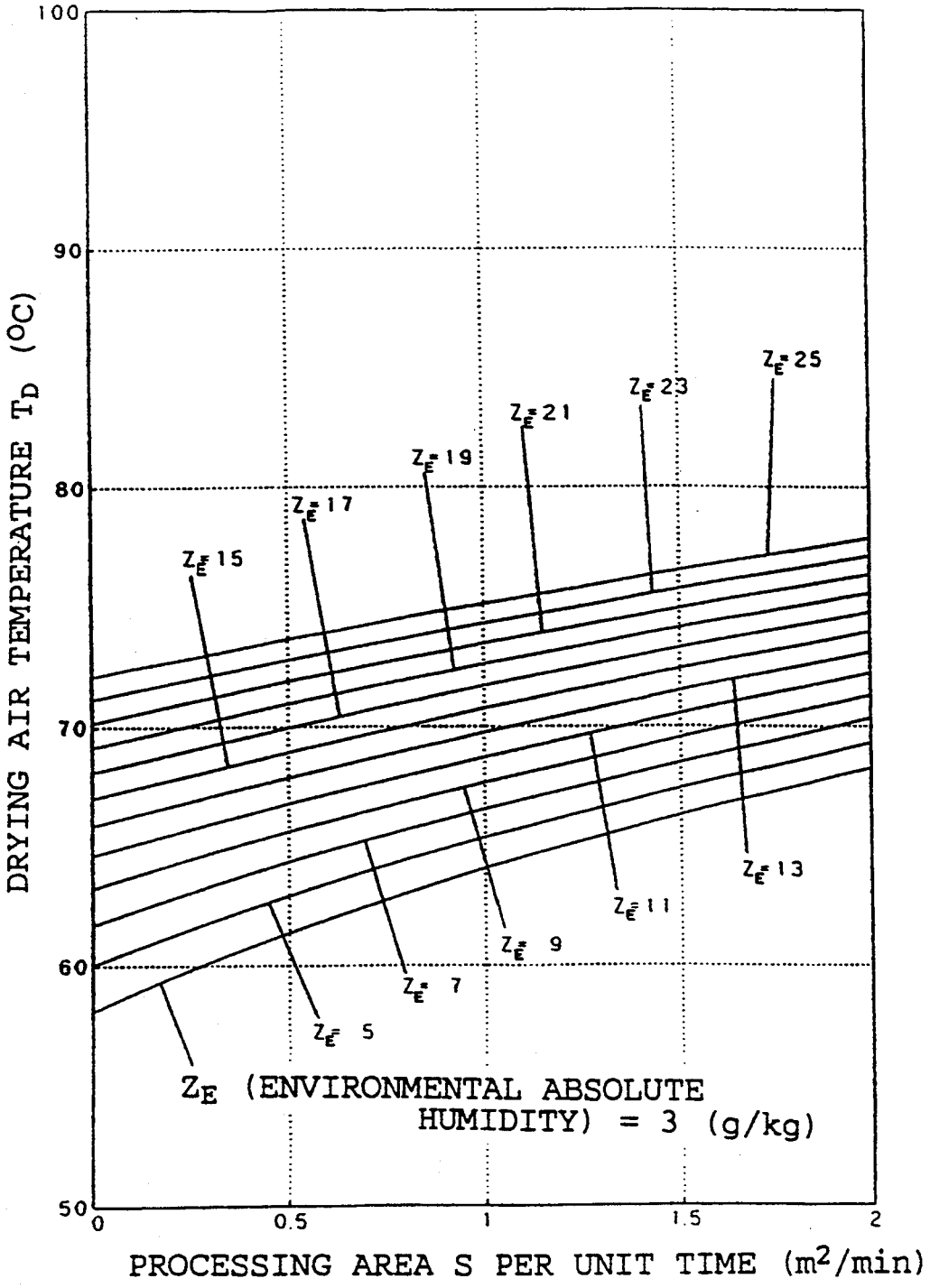
FIG. 3 is a characteristic diagram for obtaining an optimum drying air temperature on the basis of a dry processing area of a photosensitive material and the absolute humidity of the environment.

As a second method for controlling the temperature of drying air, there is a method in which, as shown in FIG. 3, a map for determining the optimum drying air temperature $T_D$ on the basis of the processing area S per unit time and the environmental absolute humidity $Z_E$ is prepared in advance, the optimum drying air temperature $T_D$ is determined on the basis of it, and the heater is controlled so as to obtain this drying air temperature $T_D$, thereby obtaining the drying air at the optimum temperature. In this second method, a map such as the one shown in FIG. 3 is stored in advance in the controller 82, and an optimum drying air temperature $T_D$ is read with reference to the map such as the one shown in FIG. 3 on the basis of the processing area S per unit time and signal inputs from the insertion detecting sensors 80, the temperature sensor 84, and the relative humidity sensor 86 (the environmental absolute humidity $Z_E$ is determined from the temperature and the relative humidity), thereby controlling the heater temperature.

It should be noted that a setting is provided such that the difference $\Delta T$ between the drying air temperature $T_D$ and the wet-bulb temperature $T_W$ (at the drying air temperature $T_D$) falls within a predetermined range (in this embodiment, 34° C.$\leqq\Delta T\leqq$37° C.; optimal when $\Delta T$=35° C.).

Hereafter, a description will be given of the operation of the automatic developing apparatus 10 shown in FIG. 1.

First, a description will be given of the processing of the film F in the automatic developing apparatus 10.

The film F inserted into the automatic developing apparatus 10 through the insertion port 15 is subjected to processing by developing solution, fixing solution, and washing water in the developing tank 14, the fixing tank 16, and the washing tank 18, and is then transported to the squeeze rack 40 so as to be squeezed. The film F thus squeezed is dried by the drying air heated in the drying section 20 and the heated transport rollers 44, and is then accommodated in the film receiving box 49 via the dry turning section 48. Thus, the strips of the film F which are consecutively inserted into the automatic developing apparatus 10 undergo processing including development, fixation, and washing, and are then dried and accommodated in the receiving box 49 consecutively.

Figure 4:
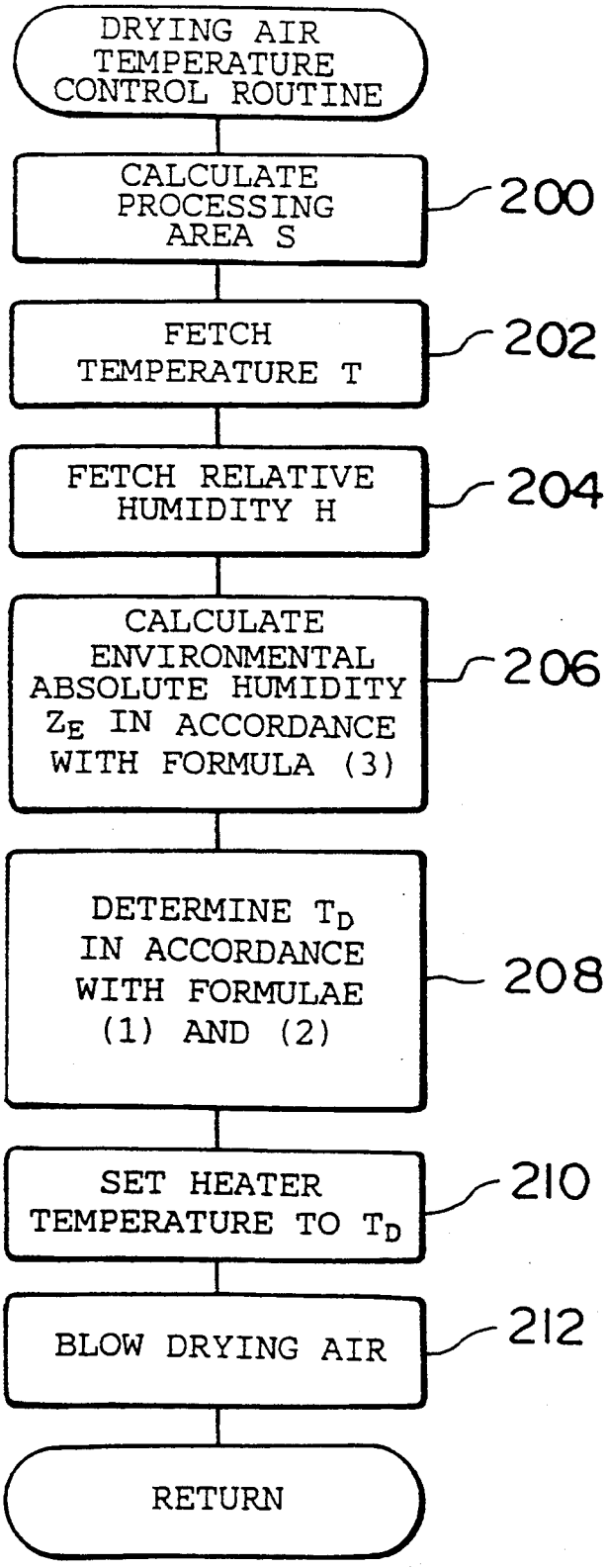
FIG. 4 is a control flowchart illustrating a routine of a first method in the control of drying air temperature for implementing the drying method in accordance with the present invention.

Here, the first method for controlling the temperature of the drying air will be described with reference to the flowchart shown in FIG. 4.

First, in Step 200, the processing area S per unit time is calculated on the basis of data inputted from the insertion detecting sensors 80. Namely, the width of the film F is determined from the number of the insertion detecting sensors 80 (arranged in the widthwise direction of the film F) which detected the film F. Next, the length of the film F is determined from the transport speed of the film F as well as the time duration from the time of the detection of the leading end of the film F by the insertion detecting sensors 80 until the time of detection of the trailing end thereof. On the basis of the product of the width and the length of the film F, the processing area S can be determined. Then, in Step 202, the temperature T detected by the temperature sensor 84 for detecting the temperature of the outside air is fetched, and, in Step 204, the relative humidity H detected by the relative humidity sensor 86 for detecting the relative humidity of the outside air is fetched. In an ensuing Step 206, Formula (3) above is read, and a calculation is made by substituting into Formula (3) the temperature T detected by the temperature sensor 84 and the relative humidity H detected by the relative humidity sensor 86. As a result, the environmental absolute humidity $Z_E$ is determined.

Then, in Step 208, the absolute humidity Z in the drying section 20 is determined by making a calculation by substituting into Formula (2) the exhausted air amount Q of the drying apparatus used, the processing area S per unit time of the film F to be dried, and the water content W of the film F prior to drying which can be estimated in advance from the type of film F and the processing solutions used in processing, in addition to the environmental absolute humidity $Z_E$ determined in Step 206. The drying air temperature $T_D$ is obtained from Formula (1) on the basis of this absolute humidity Z. Incidentally, a temperature range of, for instance, ±3° C. is allowed for the drying air temperature $T_D$.

Then, in Step 210, on the basis of the drying air temperature $T_D$ obtained in Step 208 the temperature of the unillustrated heater for heating the drying air is controlled so as to be maintained at the temperature $T_D$. The heated drying air is sent to the spray pipes 47, and is blown through the nozzle portions 47A such that the pressure of the drying air becomes uniform along the widthwise direction of the film F in the subchamber portions 47B (Step 212).

Figure 5:
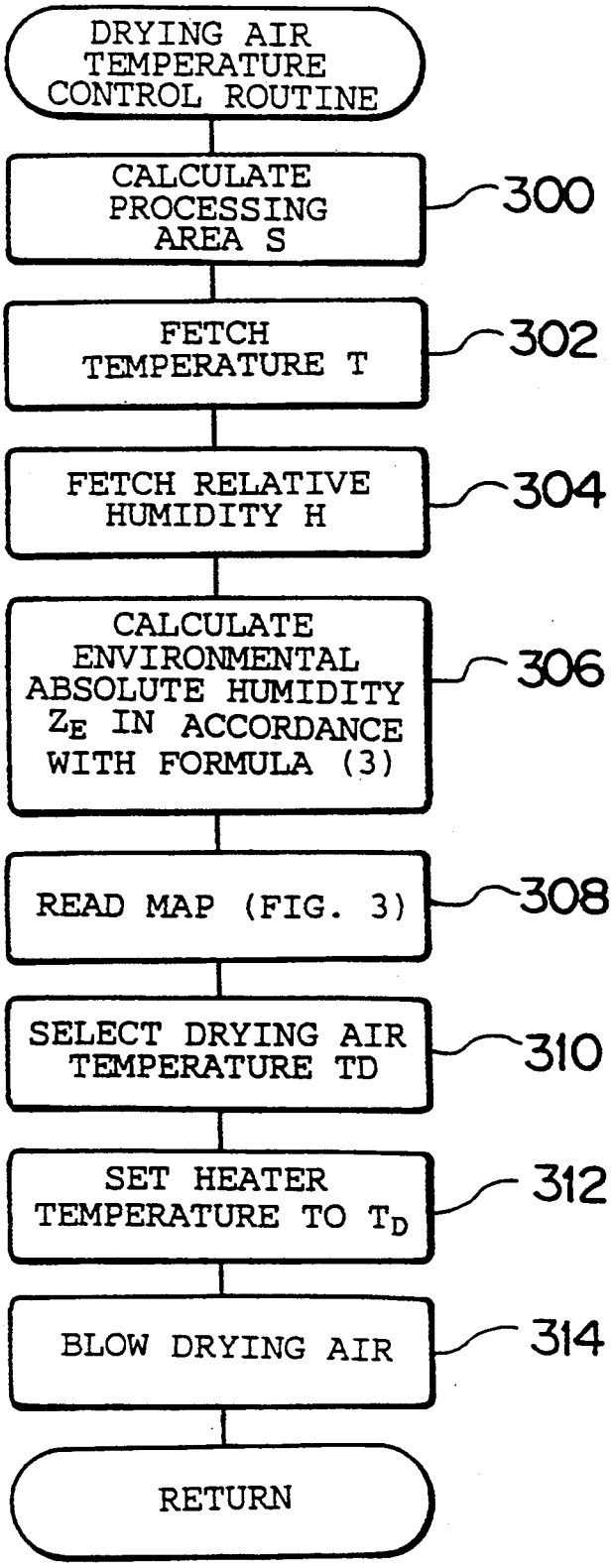
FIG. 5 is a control flowchart illustrating a routine of a second method in the control of drying air temperature for implementing the drying method in accordance with the present invention.

Referring now to the flowchart shown in FIG. 5, a description will be given of the second method for controlling the temperature of the drying air.

First, in Step 300, the processing area S per unit time is calculated on the basis of data inputted from the insertion detecting sensors 80. Namely, the width of the film F is determined from the number of the insertion detecting sensors 80 (arranged in the widthwise direction of the film F) which detected the film F. Next, the length of the film F is determined from the transport speed of the film F as well as the time duration from the time of the detection of the leading end of the film F by the insertion detecting sensors 80 until the time of detection of the trailing end thereof. On the basis of the product of the width and the length of the film F, the processing area S can be determined.

Then, the environmental absolute humidity $Z_E$ is calculated on the basis of the data inputted from the temperature sensor 84 and the relative humidity sensor 86. Namely, in Step 302, the temperature T detected by the temperature sensor 84 for detecting the temperature of the outside air is fetched, and, in Step 304, the relative humidity H detected by the relative humidity sensor 86 for detecting the relative humidity of the outside air is fetched. In an ensuing Step 306, Formula (3) above is read, and a calculation is made by substituting into Formula (3) the temperature T detected by the temperature sensor 84 and the relative humidity H detected by the relative humidity sensor 86. As a result, the environmental absolute humidity $Z_E$ is determined.

In Step 308, the map (see FIG. 3) stored in advance is read, and a curve corresponding to the environmental absolute humidity $Z_E$ is selected. In Step 310, the drying air temperature $T_D$ is selected on the basis of the processing area S calculated in Step 300.

In Step 312, the temperature of the drying air sent to the drying section 20 is controlled in such a manner as to be maintained at $T_D$ by controlling the energization of the heater. The heated drying air is sent to the spray pipes 47, and is blown through the nozzle portions 47A such that the pressure of the drying air becomes uniform along the widthwise direction of the film F in the subchamber portions 47B (Step 314).

The aforementioned map is calculated in advance on the basis of Formulae (1) and (2) above and is stored in the controller 82, and varies in accordance with the structure of the drying section 20 and the processing conditions. Namely, with the type of the structure in which drying is effected by the drying air only as in this embodiment, the coefficients $\alpha$, $\beta$, and $\gamma$ are obtained from the number and the diameter of the transport rollers 44 for transporting the film F in direct contact therewith, the number of the nozzle portions 47A of the spray pipes 47, the opening width and the opening length of the nozzle portion 47A, the drying air amount, the exhausted air amount, the virtual drying path length, the distance from the tip of the nozzle portion 47A at its opening to the film F transported in the drying section 20, and the traveling speed of the photosensitive material in the drying section 20 (see Table 1).

TABLE 1

| Configuration of Drying Section | | Measured Value | Results of Calculation of Coefficients |
|---|---|---|---|
| Transport roller: | quantity | 16 | $0.04345 \leqq \alpha \leqq 0.04654$ |
| | outside diameter | 20 mm | $-3{,}9762 \geqq \beta \geqq -4.6750$ |
| Nozzle portion: | quantity | 16 | $88.67 \leqq \gamma \leqq 115.11$ |
| | nozzle opening width | 2.5 mm | Optimum values: |
| | nozzle opening length | 470 mm | $\alpha = 0.04521$ |
| | | | $\beta = -4.3348$ |
| | | | $\gamma = 101.54$ |
| Data of Drying Section: | drying air amount | approx. 11 $m^3$/min | |
| | exhausted air amount | approx. 2 $m^3$/min | |
| | virtual drying path length | 305 mm | |
| | transport speed | 46.8 mm/sec | |
| | distance from nozzle tip to film | 5 mm | |

Thus, since it is possible to determine a drying air temperature optimally suited to the present state on the basis of the data inputted from the insertion detecting sensors 80, the temperature sensor 84, and the relative humidity sensor 86, the film F can be maintained in an optimal drying state from the processing start to the end. In the first and second methods for controlling the temperature of the drying air, it has been experimentally known that this optimal drying state is when the difference $\Delta T$ between the temperature in the drying section 20 and the wet-bulb temperature in the drying section 20 at this temperature is 34° C. to 37° C. (optimal at 35° C.). This $\Delta T$ can be maintained by effecting drying at the drying air temperature $T_D$ obtained by the above calculation.

The state of drying the film F varies depending on the structure and conditions of the drying section 20. Accordingly, it is necessary to calculate the coefficients $\alpha$, $\beta$, and $\gamma$ in accordance with the structure and conditions of the drying section 20.

As the structure of the drying section, in addition to the structure in which the film F is dried by the drying air only, as shown in FIG. 2, it is conceivable to adopt a structure which jointly uses a far infrared heater, as well as a structure which jointly uses a heat roller (a heated roller for transporting and drying the film F while bringing the film F into contact with the peripheral surface of the roller).

A description will now be given of an automatic developing apparatus (FIG. 6) having a drying section which jointly uses drying based on drying air and the far infrared heater, and of an automatic developing apparatus (FIGS. 9 and 10) having a drying section which jointly uses the heat roller, with respect to their respective configurations and methods of determining an optimum drying air temperature.

Figure 6:
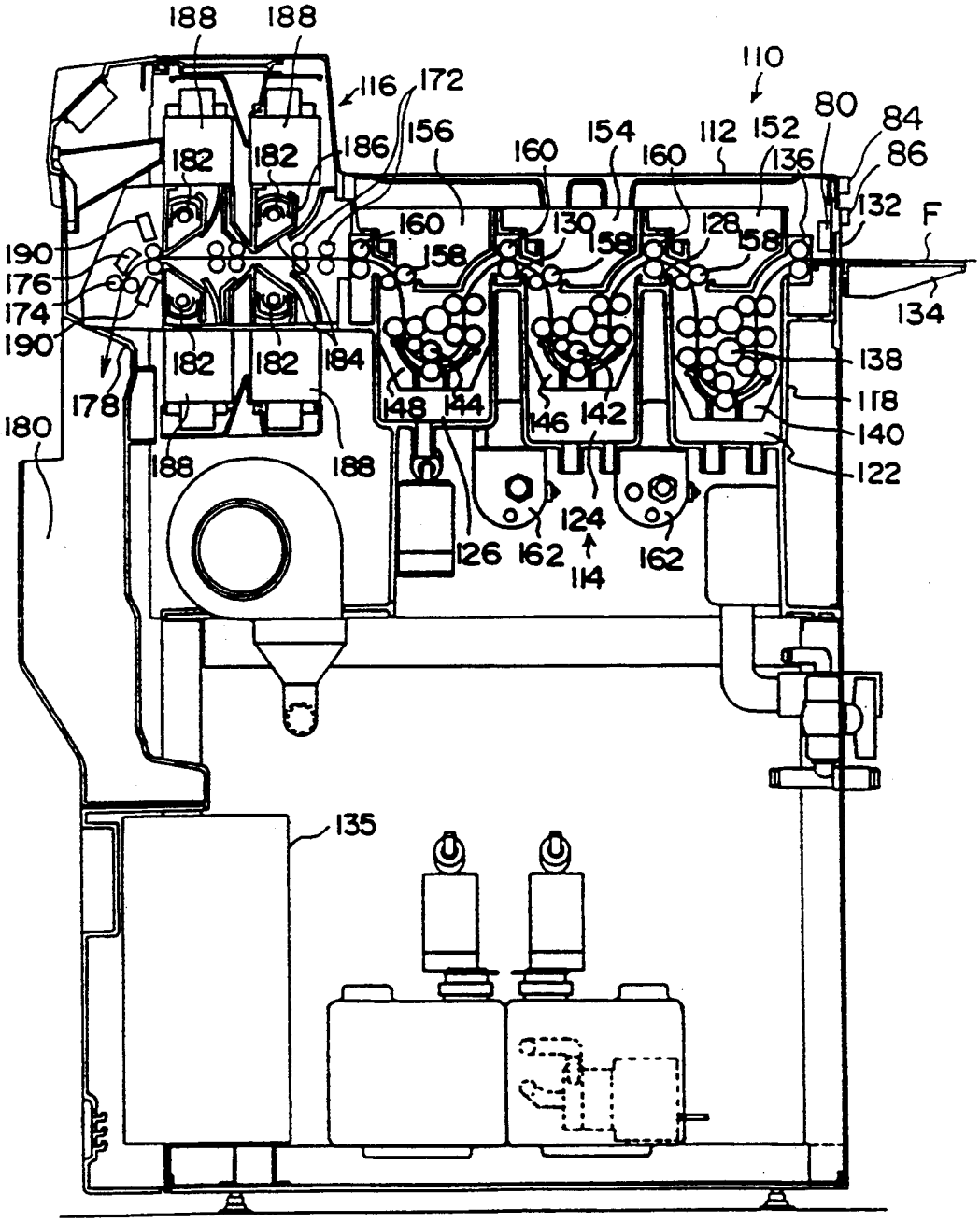
FIG. 6 is a schematic diagram of another automatic developing apparatus to which the drying method in accordance with the present invention is applied.

FIG. 6 shows an automatic developing apparatus 110 having a configuration different from the one shown in FIG. 1.

A processing section 114 and a drying section 116 are provided within a machine frame 112 of the automatic developing apparatus 110. Disposed inside the processing section 114 is a processing tank 118 which include a developing tank 122, a fixing tank 124, and a washing tank 126 that are partitioned and arranged along the direction of travel of film F (in the direction of arrow A in FIG. 7). In addition, the processing tank 118 has rinsing tanks 128 and 130 which are respectively provided between the developing tank 122 and the fixing tank 124 and between the fixing tank 124 and the washing tank 126.

An insertion table 134 which projects from the outer periphery of the machine frame 112 toward the outside is provided in the vicinity of an insertion port 132 for the film F formed in the machine frame 112 of the automatic developing apparatus 110.

Insertion detecting sensors 80 are provided at this insertion port 132, and are electrically connected to a controller 135. Accordingly, the controller 135 is capable of obtaining the width and the length of the inserted film F, in the same way as the automatic developing apparatus shown in FIG. 1.

The temperature sensor 84 and the relative humidity sensor 86 are attached to the outer peripheral portion of the machine frame 112, and are electrically connected to the controller 135.

A pair of insertion rollers 136 for drawing in the film F which was placed on the insertion table 134 and inserted through the insertion port 132 are disposed inside the machine frame 112.

A developing solution is accommodated in the developing tank 122, and a developing rack 140 having transport rollers 138 for transporting the film F by being driven by an unillustrated motor is immersed in the developing solution.

A fixing solution is accommodated in the fixing tank 124, and washing water is accommodated in the washing tank 126. A fixing rack 146 and a washing rack 148 respectively having transport rollers 142 and 144 which are driven by the unillustrated motor are disposed in such a manner as to be immersed in the fixing solution and the washing water, respectively.

Crossover racks 152, 154, and 156 are disposed above the developing tank 122, the fixing tank 124, and the washing tank 126. The respective crossover racks 152, 154, and 156 have roller pairs for feeding the film into an ensuing process, and are each arranged such that a part of a lower portion thereof serving as a guide and a part of the lower portion serving as a cover for preventing the respective processing liquid from unnecessarily coming into contact with the outside air are integrally formed.

The crossover rack 152 located above the developing tank 122 is provided with the pair of insertion rollers 136 for feeding the film into the developing tank 122, as well as a roller pair 158 for drawing out the film F from the developing tank 122 and feeding it into the ensuing fixing tank 124, and a roller pair 160 disposed in the rinsing tank 128. The rack 154 located above the fixing tank 124 is provided with the roller pair 158 for drawing out the film F from the fixing tank 124 and the roller pair 160 disposed in the rinsing tank 130. The rack 156 located above the washing tank 126 is provided with the roller pairs 158 and 160 for drawing out the film F from the washing tank 126, and these roller pairs 158 and 160 also serve to squeeze off washing water adhered to the film F.

The rollers of the crossover racks 152, 154, and 156 are rotated by a driving force transmitted by an unillustrated driving source, and transport the film F at a fixed speed together with the rollers of the developing rack 140, the fixing rack 146, and the washing rack 148 where are in the developing tank 122, the fixing tank 124, and the washing tank 126, respectively.

Heat exchangers 162 are disposed below the developing tank 122 and the fixing tank 124, respectively. The developing solution in the developing tank 122 and the fixing solution in the fixing tank 124 are each sent to the heat exchangers 162, and after being subjected to heat exchange, the solutions are sent back to the developing tank 122 and the fixing tank 124. As a result, the temperatures of the developing solution in the developing tank 122 and the fixing solution in the fixing tank 124 are maintained by the heat exchangers 162 in such a manner as to fall within predetermined ranges for processing the film F in an optimal state.

Water is accommodated in the rinsing tanks 128 and 130 as a rinsing liquid, and the rinsing tanks 128 and 130 serve to prevent the developing solution or the fixing solution sequentially adhered to the film F from being mixed in the ensuing processing tank.

The film F processed by being transported through the respective processing tank in the processing section 114 is fed into the drying section 116 adjacent to the processing section 114 by means of the rollers 160 of the crossover rack 156.

Figure 7:
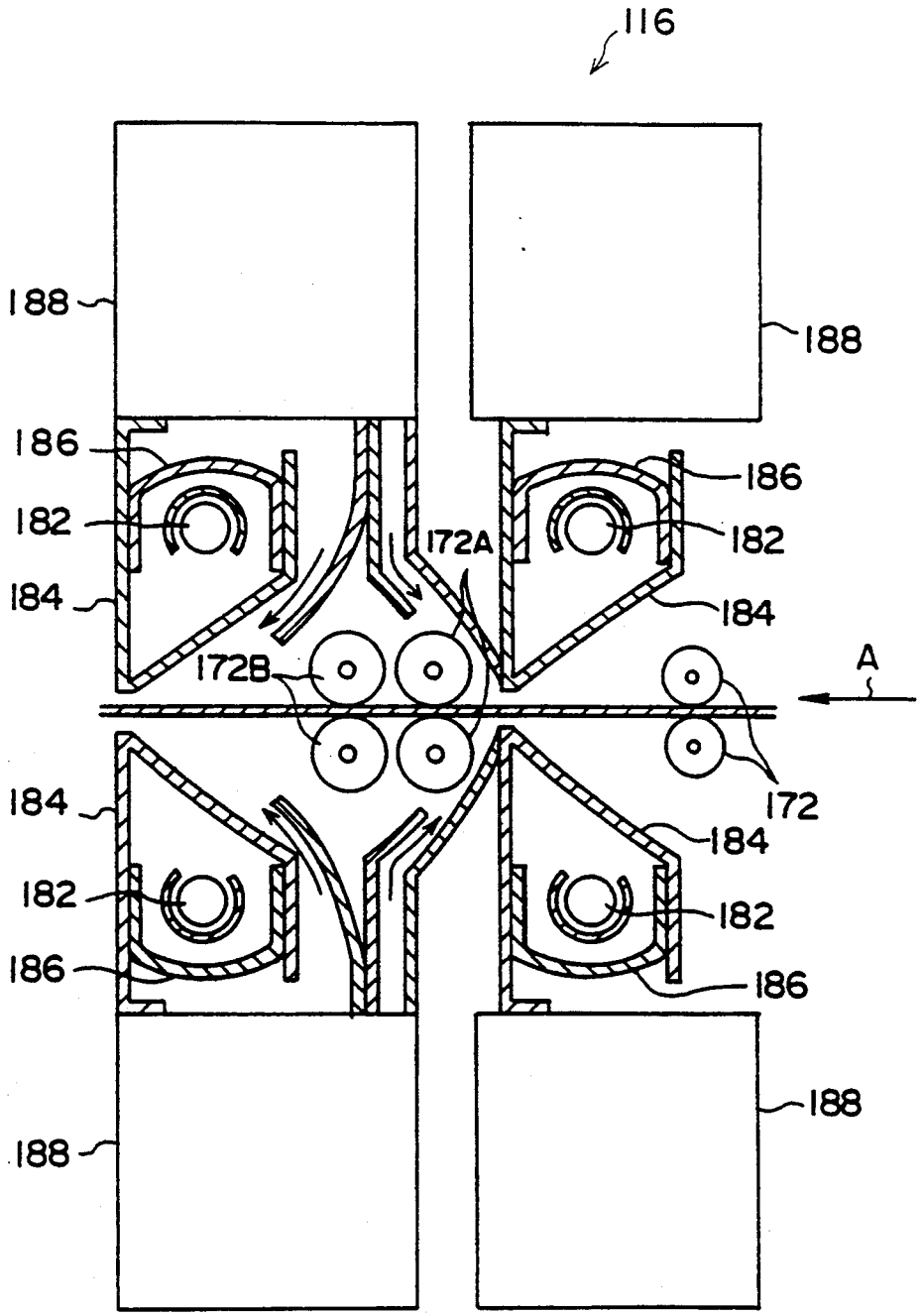
FIG. 7 is a schematic diagram illustrating the structure of a drying section of the automatic developing apparatus shown in FIG. 6.

As also shown in FIG. 7, a transport passage for transporting the film F in a substantially horizontal state is formed in the drying section 116 by a plurality of roller pairs 172A and 172B. The film F is transported substantially downward by a roller 174 and a guide 176 which are disposed on the downstream side, and is discharged into a film receiving box 180 through a discharge port 178 formed in the machine frame 112.

In the drying section 116, a plurality of far infrared heaters 182 are arranged at upper and lower positions with the transport passage of the film F located therebetween. The longitudinal direction of each of the far infrared heaters 182 is arranged perpendicularly to the direction of travel of the film F. Guides 184 formed by a stainless wire are juxtaposed along the widthwise direction of the film in such a manner as to be located between each far infrared heater 182 and the transport passage of the film F. A reflecting mirror 186 is disposed on a side of each far infrared heater 182 which is away from the side thereof facing the transport passage. For this reason, the heat which is radiated from the far infrared heaters 182 is efficiently redirected onto the surface of the film F by the reflecting mirrors 186 between the guides 184. The film F is heated and dried by this radiant heat.

The temperatures of these far infrared heaters 182 are controlled by the controller 135. In the drying section 116, a fan 188 is disposed on the side of each far infrared heater 182 which is away from the side thereof facing the transport passage of the film F. When these fans 188 are operated, the outside air is blown toward the surface of the film F. The water which has evaporated from the film F heated by the far infrared heaters 182 is removed from the vicinity of the film F by means of the outside air thus introduced, so that the film F can be dried to an optimal state without causing unevenness in drying.

With the automatic developing apparatus 110 having the above-described arrangement, the temperature $T_D$ of the drying air to be sent to the drying section is determined by a temperature $T_{IR}$ of each far infrared heater 182 (i.e., $T_D=f\{T_{IR}\}$). Accordingly, in the same way as the drying section shown in FIG. 1, it suffices if the temperature of each far infrared heater 182 is set so as to satisfy the temperature $T_D$ of the drying air which is calculated on the basis of the environmental temperature T, the relative humidity H, the processing area S of the film F per unit time, the water content W of the film F prior to drying, and the exhausted air amount Q of the drying air in the drying apparatus.

Figure 8:
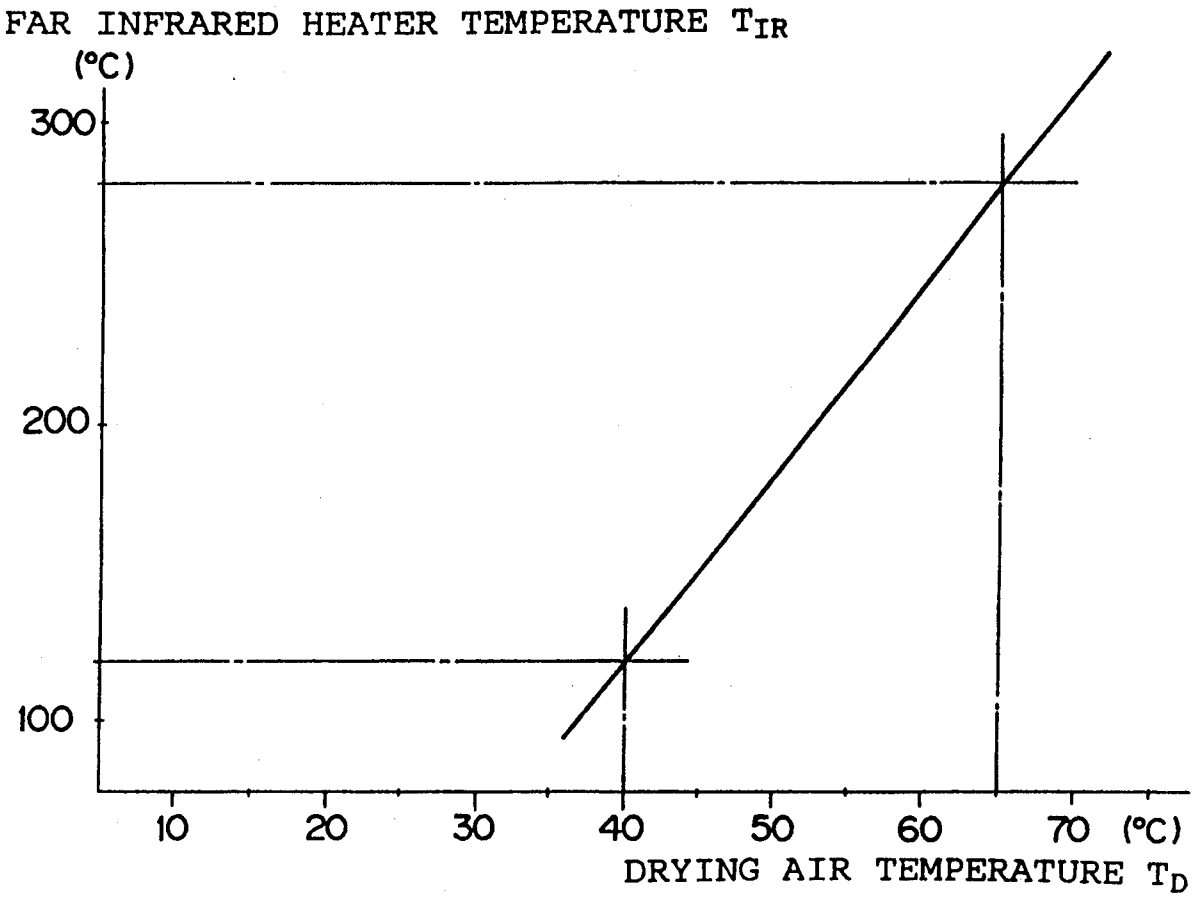
FIG. 8 is a characteristic diagram illustrating the relationships between the optimum drying air temperature and the temperature of a far infrared heater.

Here, the temperature $T_{IR}$ of the far infrared heater 182 and the drying air temperature $T_D$ are in a relationship shown in FIG. 8.

As shown in FIG. 8, the temperature $T_{IR}$ of the far infrared heater 182 and the drying air temperature $T_D$ are in a linear relationship (i.e., directly proportional). It can be seen from FIG. 8 that the range of the temperature $T_{IR}$ of the far infrared heater 182 corresponding to the temperature range (i.e., 40° C. to 65° C.) which is generally applied as the drying air temperature $T_D$ is in the range of 120° C. to 280° C.

Accordingly, according to the first method for controlling the temperature of the drying air, in the same way as in the first method for the drying section shown in FIG. 2, the environmental absolute humidity $Z_E$ is calculated in accordance with Formula (3), the temperature $T_{IR}$ of the far infrared heater 182 is read from the drying air temperature $T_D$ determined in accordance with Formula (1) and (2), and the temperature of the far infrared heater 182 is controlled so as to become the temperature thus read, thereby making it possible to constantly maintain the drying state in the drying section 116 in an optimal state. This optimal drying condition is when the difference $\Delta T$ between the temperature in the drying section 116 and the wet-bulb temperature at this temperature is in the range of 29° C. to 32° C. (optimal at 30° C.). In addition, also in the second method for controlling the temperature of the drying air, which will be described later, the same optimal drying condition holds with respect to the difference $\Delta T$ between the temperature in the drying section 116 and the wet-bulb temperature at this temperature.

In the structure of the drying section 116 shown in FIG. 6, the coefficients $\alpha$, $\beta$, and $\gamma$ assume values shown in Table 2.

In addition, a value for correcting the effect of radiant heat from the far infrared heaters 182 on drying is included in the correction coefficient K in Formula (1) above in drying in the drying section of the automatic developing apparatus shown in FIG. 6. In the second method for controlling the temperature of the drying air in this drying section, in the same way as the second method for the drying section of the automatic developing apparatus shown in FIG. 1, a map for determining the drying air temperature $T_D$ from the processing area S per unit time and the environmental absolute humidity $Z_E$ is stored in advance in the controller 135, and an optimum drying air temperature $T_D$ is read from this map on the basis of signals from the insertion detecting sensors 80, the environmental temperature sensor 84, and the environmental relative humidity sensor 86. It suffices if the temperature of each heater for heating the drying air is controlled on the basis of the drying air temperature $T_D$ thus read. Furthermore, it suffices if the temperature $T_{IR}$ of each far infrared heater is read on the basis of the drying air temperature $T_D$, and the temperature of each far infrared heater 182 is controlled so as to become the temperature thus read.

TABLE 2

| Configuration of Drying Section | | Measured Value | Results of Calculation of Coefficients |
|---|---|---|---|
| Transport roller: | quantity | opposing 3 pairs (6) | Optimum values: $\alpha = 0.04259$ $\beta = -3.517$ $\gamma = 71.47$ (The values of $\alpha$, $\beta$, and $\gamma$ have ranges corresponding to the range of $\Delta T$ in the same way as in the first embodiment) |
| | outside diameter | 20 mm | |
| Nozzle portion: | quantity | 4 | |
| | nozzle opening width | 15 mm | |
| | nozzle opening length | 380 mm | |
| Data of Drying Section: | drying air amount | approx. 1.8 $m^3$/min | |
| | exhausted air amount | approx. 0.7 $m^3$/min | |
| | virtual drying path length | 150 mm | |
| | transport speed | 19.9 mm/sec | |
| | distance from nozzle tip to film | 8 mm | |

Figure 9:
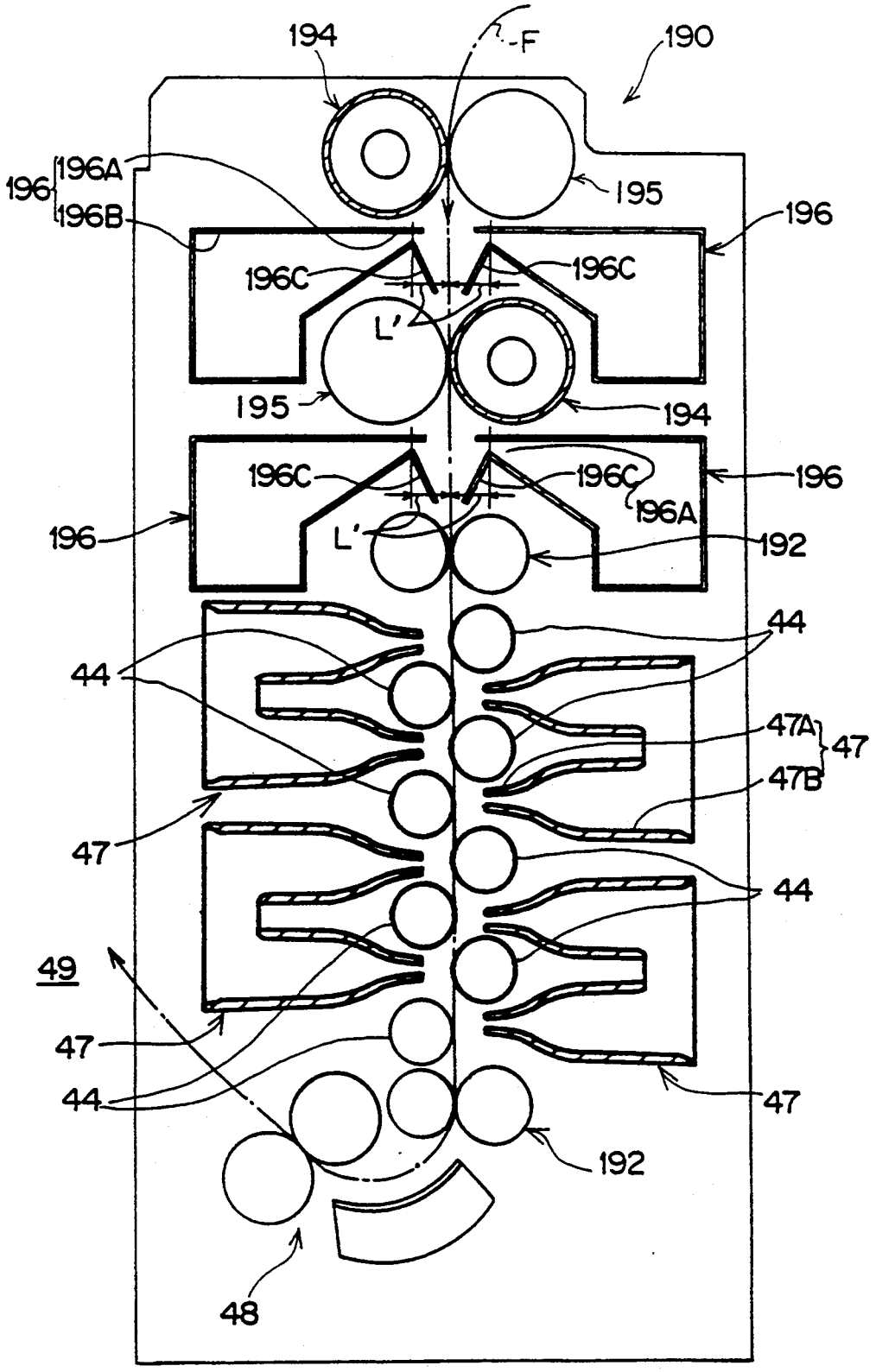
FIG. 9 is a schematic diagram of a third drying section to which the drying method in accordance with the present invention is applied.

A description will now be given of a drying section, shown in FIG. 9, in which heat rollers are jointly used. It should be noted that, as for the arrangement of the automatic developing apparatus having this drying section except for the drying section, the processing section using the processing solutions is identical to that of the automatic developing apparatus shown in FIG. 1, so that the arrangement of only a drying section 190 is shown in FIG. 9. In the structure of the drying section 190, the same component parts as those shown in FIG. 1 are denoted by the same reference numerals, and a detailed description thereof will be omitted.

As shown in FIG. 9, the drying section 190 is arranged such that the film F is transported vertically downward, and the transport rollers 44 are arranged in a zigzag manner along the transport passage. Four transport rollers 44 are disposed on each of the obverse and reverse sides of the film F, i.e., a total of eight transport rollers, and guide roller pairs 192 are respectively disposed on the upstream and downstream sides of the transport rollers 44. Furthermore, the dry turning section 48 is disposed downstream from the lower guide roller pair 192, and the film F substantially undergoes a U-turn at this dry turning section 48, and is sent to the film receiving box 49 provided on the outer side of the drying section 190.

A pair of heat rollers 194 which pairs with a pair of resilient rubber rollers (e.g., silicone rubber rollers) 195 are disposed on the upstream side of the upper guide roller pair 192. Each of these heat rollers 194 has a diameter (i.e., 40 mm) greater than that of the transport roller 44. A heat source (e.g., a halogen lamp) is provided inside the heat roller 194, and the heat roller 194 is heated by this heat source. This heating temperature $T_{HR}$ is controlled at a substantially fixed degree (in the example shown in FIG. 9, $T_{HR}=100°$ C.)

Spray pipes 196 and 47 are disposed on the sides of the heat rollers 194, the resilient rubber rollers 195, and the transport rollers 44 which are away from their sides facing the transport passage of the film F. The spray pipe 47 disposed in the vicinity of the transport roller 44 has the same structure as that shown in the first embodiment, and two nozzle portions 47A project from the subchamber portion 47B of one spray pipe 47 to between the transport rollers 44 and between the guide roller pair 192 and the transport roller 44.

Meanwhile, the spray pipe 196 disposed in the vicinities of the heat roller 194 and the resilient rubber roller 195 has one nozzle portion 196A formed with respect to one subchamber portion 196B. A bent portion 196C which is bent substantially in a V-shape toward the downstream side is formed at a lower end of a tip of the nozzle 196A. This bent portion 196C serves as a guide for reliably guiding the film F in the downward direction.

Here, since the content $W_1$ of water which is dried by the heat roller 194 is mostly determined by the temperature $T_{HR}$ of the heat roller 194, it suffices if the content $W_2$ of water remaining in the film F without being evaporated upon heating by the hear roller 194 after passing by the heat roller 194 is dried by drying air.

Accordingly, the drying capability based on the drying air may be relatively low. In terms of an optimal drying condition in the example of FIG. 9, the difference $\Delta T$ between the temperature in the drying section 190 and the wet-bulb temperature at this temperature is set in the range of 24° C. to 27° C. (an optimum value being 25° C.). This condition holds true of both the first and second methods for controlling the temperature of the drying air.

Under this condition, in the first method for controlling the temperature of the drying air, in the same way as in the first method for the example of the drying section shown in FIG. 2, the environmental absolute humidity $Z_E$ is calculated from the environmental temperature T and the environmental relative humidity H in accordance with Formula (3), the drying air temperature $T_D$ is determined in accordance with Formulae (1) and (2), and the heaters for heating the drying air is controlled on the basis of this drying air temperature $T_D$. It should be noted that an answer to Formula (2) in this embodiment is $Z=Z_E+(W.S/Q)=430.52\times S$.

In the structure of the drying section 190 shown in FIG. 9, the coefficients $\alpha$, $\beta$, and $\gamma$ assume values shown in Table 3.

As for the second method for controlling the temperature of the drying air in the drying section shown in FIG. 9, in the same way as the second method for the automatic developing apparatus shown in FIG. 1, a map for determining the drying air temperature $T_D$ from the processing area S per unit time and the environmental absolute humidity $Z_E$ is stored in advance in the controller 82 shown in FIG. 1, and an optimum drying air temperature $T_D$ is read from the map on the basis of signals from the insertion detecting sensors 80, the environmental temperature sensor 84, and the environmental relative humidity sensor 86. The temperature of each heater for heating the drying air is controlled on the basis of the drying air temperature $T_D$ thus read.

TABLE 3

| Configuration of Drying Section | | Measured Value | Results of Calculation of Coefficients |
|---|---|---|---|
| Heat roller: | quantity | 2 | Optimum values: |
| | outside diameter | 40 mm | $\alpha = 0.03701$ |
| Transport | quantity | 8 | $\beta = -2.4826$ |
| roller: | outside diameter | 20 mm | $\gamma = 40.7206$ |
| Nozzle portion: | quantity | 4 | (The values of |
| (Heat roller | slit opening width | 3 mm | $\alpha$, $\beta$, and $\gamma$ have |
| side) | slit opening length | 470 mm | ranges corre- |
| | distance from nozzle tip to film | 8 mm | sponding to the range of $\Delta T$ in |
| Nozzle portion: | quantity | 8 | the same way as |
| (Transport | slit opening width | 2.5 mm | in the first |
| roller side) | slit opening length | 470 mm | embodiment) |
| | distance from nozzle tip to film | 5 mm | |
| Data of drying | drying air amount | approx. 9 $m^3$/min | |
| section: | exhausted air amount | approx. 2 $m^3$/min | |
| | virtual drying path length | 285 mm | |
| | transport speed | 72.5 mm/sec | |

It should be noted that the aforementioned drying air temperature $T_D$ is applied when the temperature $T_{HR}$ of the heat roller 194 is 100° C. By changing the temperature $T_{HR}$ of this heat roller 194, there arises a need to change the $\Delta T$, so that the drying air temperature $T_D$ also changes. In the example of this third drying section, the reason for setting the temperature $T_{HR}$ of the heat roller 194 to 100° C. is because the relationship between the drying efficiency and the heat-resistant temperature of the film F is taken into consideration.

In addition, the distance from the tip of the nozzle provided in the vicinity of the heat roller shown in Table 3 to the film refers to a value L' shown in FIG. 9.

Next, a description will be given of an example of a fourth drying section. In this fourth drying section, the same component parts as those of the first drying section are denoted by the same reference numerals, and description thereof will be omitted.

Figure 10:
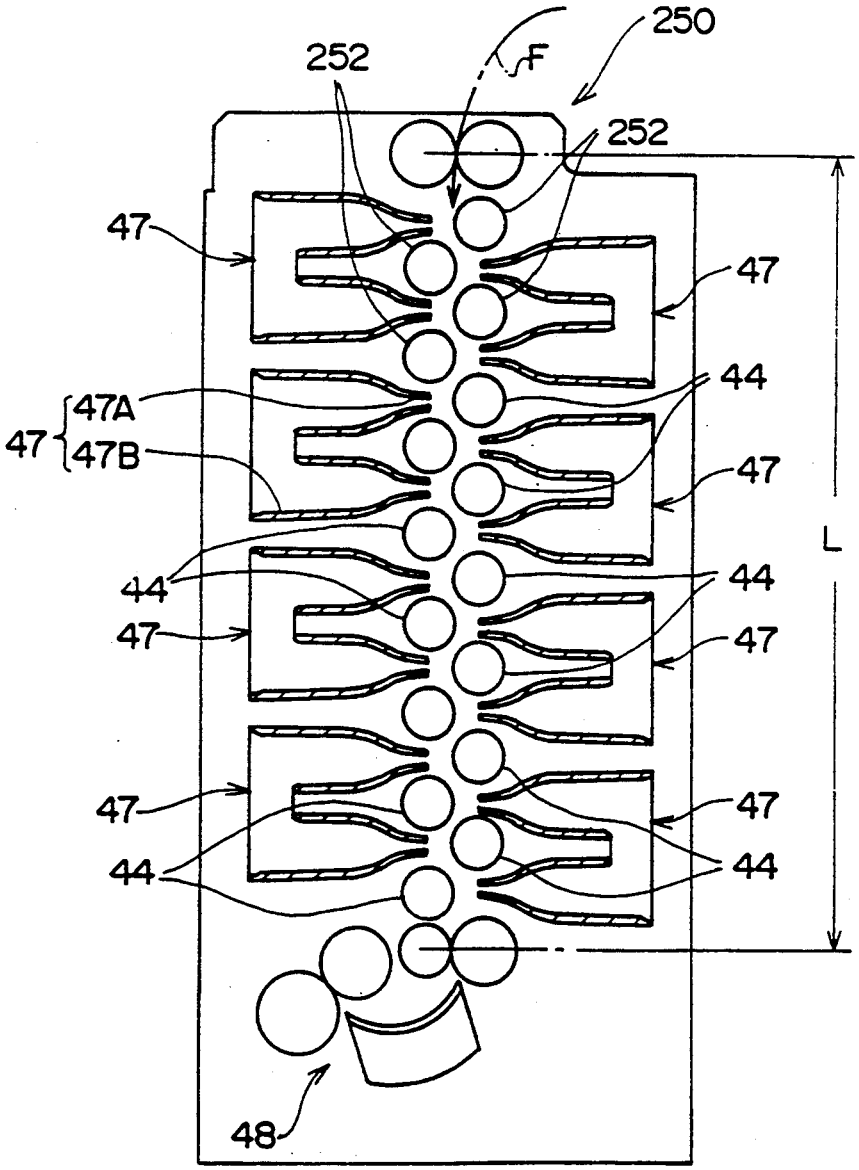
FIG. 10 is a schematic diagram of a fourth drying section to which the drying method in accordance with the present invention is applied.

As shown in FIG. 10, a fourth drying section 250 has substantially the same structure as that of the drying section shown in the example of the first drying section, except that the four rollers located on the upstream side of the transport passage in the drying section 250 are heat rollers 252. The temperature $T_{HR}$ at the outer periphery of each of these heat rollers 252 is controlled so as to be maintained at 95° C. For this reason, the film F for which processing by the processing solutions has been completed first comes into contact with the outer peripheries of the heat rollers 252 in the drying section 250, thereby accelerating drying. Then, while the film F is being transported by the transport rollers 44, the film F is further dried by the drying air discharged from the nozzle portions 47A of the spray pipes 47.

In the example of this fourth drying section, unlike the third drying section, it is necessary to take into consideration the effect of the drying air when one side of the film F is in contact with the heat roller 252.

Namely, since the heat rollers 252 of this fourth drying section are arranged in a zigzag manner, the contact length whereby the film F is in contact with the heat roller 252 is very small. Accordingly, the amount of heat conducted to the film F is small, so that the amount of heat received from the drying air is relatively large.

Here, the drying capability of the drying air needs to be set to be relatively high, and may be lower than at the time when only the drying air is used for the first drying section. For this reason, as an optimal drying condition in this fourth drying section, the difference $\Delta T$ between the temperature in the drying section 250 and the wet-bulb temperature at this temperature is set in the range of 32° C. to 35° C. (an optimum value being 33° C.). This condition holds true of both the first and second methods for controlling the temperature of the drying air.

Under this condition, in the same way as the first method for the first drying section for controlling the temperature of the drying air, the environmental absolute humidity $Z_E$ is calculated from the environmental temperature T and the environmental relative humidity H in accordance with Formula (3), the drying air temperature $T_D$ is determined in accordance with Formulae (1) and (2), and the heaters for heating the drying air is controlled on the basis of this drying air temperature $T_D$. It should be noted that an answer to Formula (2) in this drying section is $Z=Z_E+(W.S/Q)=430.52\times S$.

In the structure of this fourth drying section 250, the coefficients $\alpha$, $\beta$, and $\gamma$ assume values shown in Table 4.

TABLE 4

| Configuration of Drying Section | | Measured Value | Results of Calculation of Coefficients |
|---|---|---|---|
| Heat roller: | quantity | 4 | Optimum values: |
| | outside diameter | 20 mm | $\alpha = 0.041667$ |
| Transport roller: | quantity | 12 | $\beta = -3.6667$ |
| | outside diameter | 20 mm | $\gamma = 78.225$ |
| Nozzle portion: | quantity | 4 | (The values of |
| ( Heat roller side ) | slit opening width | 2.5 mm | $\alpha$, $\beta$, and $\gamma$ have ranges corre- |
| | slit opening length | 470 mm | sponding to the range of $\Delta T$ in |
| Nozzle portion: | quantity | 12 | the same way as |
| ( Transport roller side ) | slit opening width | 2.5 mm | in the first |
| | slit opening length | 470 mm | embodiment) |
| Data of drying section: | drying air amount | approx. 11 $m^3$/min | |
| | exhausted air amount | approx. 2 $m^3$/min | |
| | virtual drying path length | 305 mm | |
| | transport speed | 72.5 mm/sec | |
| | distance from nozzle tip to film | 5 mm | |

It should be noted that the aforementioned drying air temperature $T_D$ is applied when the temperature $T_{HR}$ Of the heat roller 252 is 95° C. By changing the temperature $T_{HR}$ of this heat roller 252, there arises a need to change the $\Delta T$, so that the drying air temperature $T_D$ also changes. In this fourth embodiment, the reason for setting the temperature $T_{HR}$ of the heat roller 252 to 95° C. is because the drying capability based on the heat roller 252 is more efficient than the drying capability based on drying air and also because the relationship between the drying efficiency and the heat-resistant temperature of the film F is taken into consideration.

As for the second method for controlling the temperature of the drying air, in the same way as the second method for the first drying section, a map for determining the drying air temperature $T_D$ from the processing area S per unit time and the environmental absolute humidity $Z_E$ is stored in advance in the controller 82 shown in FIG. 1, and an optimum drying air temperature $T_D$ is read from this map on the basis of signals from the insertion detecting sensors 80, the environmental temperature sensor 84, and the environmental relative humidity sensor 86. The temperature of each heater for heating the drying air is controlled on the basis of the drying air temperature $T_D$ thus read.

It should be noted that although in the first to fourth drying sections, the environmental absolute humidity $Z_E$ is determined from the environmental temperature T and the relative humidity H, the present invention is not limited to the same, and it is possible to use a device which directly detects the environmental absolute humidity $Z_E$.

What is claimed is:

1. A method of controlling the temperature of drying air in a photosensitive material drying apparatus for drying the photosensitive material processed by processing solutions, comprising the steps of:

calculating an environmental absolute humidity $Z_E$ of a vicinity of said photosensitive material drying apparatus;

calculating a processing amount S of the photosensitive material per unit time;

calculating a drying air temperature $T_D$ on the basis of the environmental absolute humidity $Z_E$ and the processing amount S of the photosensitive material so that a difference between the drying air temperature $T_D$ and a wet-bulb temperature TW in said photosensitive material drying apparatus falls within a predetermined range of a value; and controlling a first heater for heating the drying air on the basis of the drying air temperature $T_D$.

2. A method of controlling the temperature of drying air in a photosensitive material drying apparatus according to claim 1, wherein, in the step of calculating the environmental absolute humidity, the environmental absolute humidity $Z_E$ is calculated from an environmental temperature T in the vicinity of said photosensitive material drying apparatus and an environmental relative humidity H.

3. A method of controlling the temperature of drying air in a photosensitive material drying apparatus according to claim 1, wherein, in the step of calculating the processing amount, the processing amount S of the photosensitive material is calculated on the basis of an area of the photosensitive material which is calculated by detecting a width of the photosensitive material inserted into said photosensitive material drying apparatus and an inserted length of the photosensitive material per unit time.

4. A method of controlling the temperature of drying air in a photosensitive material drying apparatus according to claim 1, wherein, in the step of calculating the drying air temperature, the drying air temperature $T_D$ is calculated by reading a characteristic diagram which makes it possible to obtain the drying air temperature $T_D$ on the basis of the processing amount S of the photosensitive material per unit time and the environmental absolute humidity $Z_E$.

5. A method of controlling the temperature of drying air in a photosensitive material drying apparatus according to claim 1, wherein, in the step of calculating the drying air temperature, the drying air temperature $T_D$ is calculated such that the difference between the drying air temperature $T_D$ and the wet-bulb temperature TW in said photosensitive material drying apparatus becomes greater than or equal to 34° C. and less than or equal to 37° C.

6. A method of controlling the temperature of drying air in a photosensitive material drying apparatus according to claim 1, further comprising the steps of:

calculating the temperature of a second heater, provided in said photosensitive material drying apparatus for heating the photosensitive material, on the basis of the drying air temperature $T_D$; and controlling said second heater on the basis of the calculated temperature of said second heater.

7. A method of controlling the temperature of drying air in a photosensitive material drying apparatus according to claim 6, wherein, in the step of calculating the drying air temperature, the drying air temperature $T_D$ is calculated such that the difference between the drying air temperature $T_D$ and the wet-bulb temperature TW in said photosensitive material drying apparatus becomes greater than or equal to 29° C. and less than or equal to 32° C.

8. A method of controlling the temperature of drying air in a photosensitive material drying apparatus according to claim 1, further comprising the steps of:

calculating a temperature of a heat roller on the basis of the drying air temperature $T_D$, said heat roller being provided in said photosensitive material drying apparatus in such a manner as to be capable of nipping the photosensitive material in cooperation with a nip roller provided in said photosensitive material drying apparatus; and controlling said heat roller on the basis of the calculated temperature of said heat roller.

9. A method of controlling the temperature of drying air in a photosensitive material drying apparatus according to claim 8, wherein, in the step of calculating the drying air temperature, the drying air temperature $T_D$ is calculated such that the difference between the drying air temperature $T_D$ and the wet-bulb temperature TW in said photosensitive material drying apparatus becomes greater than or equal to 24° C. and less than or equal to 27° C.

10. A method of controlling the temperature of drying air in a photosensitive material drying apparatus according to claim 1, further comprising the steps of:

calculating a temperature of a plurality of heat rollers on the basis of the drying air temperature $T_D$, said plurality of heat rollers being provided in said photosensitive material drying apparatus and arranged in a zigzag manner along a transport passage; and controlling said plurality of heat rollers on the basis of the calculated temperature of said plurality of heat rollers.

11. A method of controlling the temperature of drying air in a photosensitive material drying apparatus according to claim 10, wherein, in the step of calculating the drying air temperature, the drying air temperature $T_D$ is calculated such that the difference between the drying air temperature $T_D$ and the wet-bulb temperature TW in said photosensitive material drying apparatus becomes greater than or equal to 32° C. and less than or equal to 35° C.

12. A method of controlling the temperature of drying air for use in a photosensitive material drying apparatus for drying the photosensitive material processed by processing solutions, and for drying the photosensitive material being transported in said photosensitive material drying apparatus by using the drying air heated by a first heater, comprising the steps of:

calculating an environmental absolute humidity $Z_E$ of a vicinity of said photosensitive material drying apparatus;

calculating a processing amount S of the photosensitive material per unit time;

calculating a drying air temperature $T_D$ on the basis of the environmental absolute humidity $Z_E$, the processing amount S of the photosensitive material, a water content W of the photosensitive material prior to drying, and an exhausted air amount Q of the drying air so that a difference between the drying air temperature $T_D$ and a wet-bulb temperature TW in said photosensitive material drying apparatus falls within a predetermined range of a value; and controlling said first heater on the basis of the drying air temperature $T_D$.

13. A method of controlling the temperature of drying air in a photosensitive material drying apparatus according to claim 12, wherein, if it is assumed that coefficients are $\alpha$, $\beta$, and $\gamma$ and a correction coefficient is K, the drying air temperature $T_D$ is expressed by the following formulae:

$$T_D = \frac{-\beta + \sqrt{\beta^2 - 4\alpha(\gamma - Z)}}{2\alpha} + K \quad (1)$$

$$Z = Z_E + \frac{W \cdot S}{Q} \quad (2)$$

14. A method of controlling the temperature of drying air in a photosensitive material drying apparatus according to claim 12, wherein, in the step of calculating the environmental absolute humidity, the environmental absolute humidity $Z_E$ is calculated from an environmental temperature T in the vicinity of said photosensitive material drying apparatus and an environmental relative humidity H.

15. A method of controlling the temperature of drying air in a photosensitive material drying apparatus according to claim 12, wherein, in the step of calculating the processing amount, the processing amount S of the photosensitive material is calculated on the basis of an area of the photosensitive material which is calculated by detecting a width of the photosensitive material inserted into said photosensitive material drying apparatus and an inserted length of the photosensitive material per unit time.

16. A method of controlling the temperature of drying air in a photosensitive material drying apparatus according to claim 12, wherein, in the step of calculating the drying air temperature, the drying air temperature $T_D$ is calculated such that the difference between the drying air temperature $T_D$ and the wet-bulb temperature TW in said photosensitive material drying apparatus becomes greater than or equal to 34° C. and less than or equal to 37° C.

17. A method of controlling the temperature of drying air in a photosensitive material drying apparatus according to claim 12, further comprising the steps of:

calculating the temperature of a second heater, disposed in said photosensitive material drying apparatus, on the basis the drying air temperature $T_D$; and controlling said second heater on the basis of the calculated temperature of said second heater.

18. A method of controlling the temperature of drying air in a photosensitive material drying apparatus according to claim 17, wherein, in the step of calculating the drying air temperature, the drying air temperature $T_D$ is calculated such that the difference between the drying air temperature $T_D$ and the wet-bulb temperature TW in said photosensitive material drying apparatus becomes greater than or equal to 29° C. and less than or equal to 32° C.

19. A method of controlling the temperature of drying air in a photosensitive material drying apparatus according to claim 12, further comprising the steps of:

calculating a temperature of a first heat roller on the basis of the drying air temperature $T_D$, said first heat roller being provided in said photosensitive material drying apparatus in such a manner as to be capable of nipping the photosensitive material in cooperation with a nip roller provided in said photosensitive material drying apparatus; and controlling said first heat roller on the basis of the calculated temperature of said heat roller.

20. A method of controlling the temperature of drying air in a photosensitive material drying apparatus according to claim 12, further comprising the steps of:

calculating a temperature of a plurality of second heat rollers on the basis of the drying air temperature $T_D$, said plurality of second heat rollers being provided in said photosensitive material drying apparatus and arranged in a zigzag manner along a transport passage; and controlling said plurality of second heat rollers on the basis of the calculated temperature of said plurality of second heat rollers.

* * * * *